US010413943B2

(12) United States Patent
Vasanthan

(10) Patent No.: US 10,413,943 B2
(45) Date of Patent: Sep. 17, 2019

(54) METHOD FOR FRACTIONATING GRAIN

(71) Applicant: GRAINFRAC INC., Edmonton (CA)

(72) Inventor: Thavaratnam Vasanthan, Edmonton (CA)

(73) Assignee: GRAINFRAC INC., Edmonton, Alberta (CA)

( * ) Notice: Subject to any disclaimer, the term of this patent is extended or adjusted under 35 U.S.C. 154(b) by 0 days.

(21) Appl. No.: 16/032,836

(22) Filed: Jul. 11, 2018

(65) Prior Publication Data

US 2018/0318879 A1 Nov. 8, 2018

Related U.S. Application Data

(62) Division of application No. 15/120,450, filed as application No. PCT/CA2015/050126 on Feb. 19, 2015, now Pat. No. 10,046,366.

(Continued)

(51) Int. Cl.
*B07B 9/00* (2006.01)
*B07B 4/02* (2006.01)

(Continued)

(52) U.S. Cl.
CPC ..... *B07B 9/00* (2013.01); *B07B 4/02* (2013.01); *B07B 4/025* (2013.01); *B07B 4/08* (2013.01);

(Continued)

(58) Field of Classification Search
CPC .... B07B 9/00; B07B 4/00; B07B 4/02; B07B 4/025; B07B 4/08; B07B 7/01; B07B 7/06

(Continued)

(56) References Cited

U.S. PATENT DOCUMENTS 3,948,764 A * 4/1976 Edwards ..... B07B 1/46 209/30
4,261,817 A * 4/1981 Edwards ..... B07B 4/08 209/321

(Continued)

FOREIGN PATENT DOCUMENTS

EP 0978328 A2 2/2000
GB 1170453 11/1969

(Continued)

OTHER PUBLICATIONS

International Search Report for International Application No. PCT/CA2015/050126, dated May 4, 2015.

(Continued)

*Primary Examiner* — Terrell H Matthews
(74) *Attorney, Agent, or Firm* — Heslin Rothenberg Farley & Mesiti P.C.; Victor A. Cardona, Esq.

(57) ABSTRACT

A method for fractionating a milled grain product into coarse and fine fractions includes providing a sieving apparatus with a bottom chamber divided from a top chamber by a sieve, an inlet port in the top chamber, a top chamber cover defined by a plurality of openings, and a first exit port in the bottom chamber, and applying vacuum suction to the sieving apparatus. The vacuum suction is configured to draw grain particles through the inlet port into the top chamber, generate substantially horizontal airflow in the top chamber via the inlet port; and generate substantially vertical airflow in the top chamber via the plurality of openings, wherein the substantially horizontal airflow and the substantially vertical airflow combine to generate turbulence which fluidizes the grain particles in the upper chamber and prevents blockage of the sieve; and drawing fine grain particles through the sieve and out of the bottom chamber via the first exit port (Continued)

under the vacuum suction and collecting a fine grain particle fraction.

20 Claims, 2 Drawing Sheets

Related U.S. Application Data

(60) Provisional application No. 61/942,376, filed on Feb. 20, 2014.

(51) Int. Cl.
*B07B 7/01* (2006.01)
*B07B 4/08* (2006.01)
*B07B 7/06* (2006.01)
*B07B 13/16* (2006.01)

(52) U.S. Cl.
CPC ..... *B07B 7/01* (2013.01); *B07B 7/06* (2013.01); *B07B 13/16* (2013.01)

(58) Field of Classification Search
USPC ..... 209/21, 22, 23, 24, 25, 133, 134, 135, 209/136, 142
See application file for complete search history.

(56) References Cited

U.S. PATENT DOCUMENTS

| | | | | |
|---|---|---|---|---|
| 4,268,382 | A | 5/1981 | Hanke et al. | |
| 4,351,373 | A * | 9/1982 | Mechalas | B07B 1/24 141/51 |
| 4,678,560 | A * | 7/1987 | Stole | B07B 9/00 209/138 |
| 4,680,107 | A | 7/1987 | Manola | |
| 4,806,235 | A * | 2/1989 | Mueller | B07B 1/46 209/321 |
| 4,931,173 | A * | 6/1990 | Lesher | B07B 4/025 209/138 |
| 4,946,044 | A * | 8/1990 | Havrilla | B03B 4/02 209/138 |
| 5,019,242 | A | 5/1991 | Donelson | |
| 5,348,161 | A | 9/1994 | Mueller | |
| 5,645,171 | A | 7/1997 | Felden | |
| 7,424,956 | B2 | 9/2008 | Kohno | |
| 7,910,143 | B2 | 3/2011 | Kvist et al. | |
| 7,976,888 | B2 | 7/2011 | Hellweg et al. | |
| 8,061,523 | B2 * | 11/2011 | Uebayashi | B07B 1/34 209/20 |
| 2010/0071616 | A1 | 3/2010 | Mauchle et al. | |
| 2011/0253601 | A1 | 10/2011 | Kaiser et al. | |
| 2014/0216991 | A1 * | 8/2014 | Suhin | B07B 4/02 209/644 |

FOREIGN PATENT DOCUMENTS

| | | | |
|---|---|---|---|
| GB | 1241774 | A | 8/1971 |
| JP | S5926174 | A | 2/1984 |
| JP | S61249578 | A | 11/1986 |
| JP | 2000135474 | A | 5/2000 |
| JP | 2002035698 | A | 2/2002 |
| JP | 2004508844 | A | 3/2004 |
| JP | 2007301490 | A | 11/2007 |
| JP | 2008043854 | A | 2/2008 |

OTHER PUBLICATIONS

Supplemental European Search Report dated Oct. 9, 2017 for corresponding EP Application No. 15796777.9, dated Oct. 16, 2017.
English Translation of Office Action in Japanese Patent Application No. 2016-570148 dated Jul. 24, 2018.
English Translation of Office Action in Japanese Patent Application No. 2016-570148 dated Dec. 4, 2018.

* cited by examiner

METHOD FOR FRACTIONATING GRAIN

CROSS REFERENCE TO RELATED APPLICATIONS

This application is a divisional of U.S. patent application Ser. No. 15/120,450 which is a National Stage entry of PCT Application PCT/CA2015/050126, filed on Feb. 19, 2015 and claiming the benefit of priority to U.S. Provisional Patent Application Ser. No. 61/942,376 filed on Feb. 20, 2014, the entire disclosures of which are incorporated herein by reference

FIELD OF THE INVENTION

The invention relates to an apparatus, system and method for fractionating grain products to obtain fractions with enhanced dietary fiber content and/or enhanced content of starches and/or proteins. The apparatus is configured to carry out air-current assisted particle separation (ACAPS) of the unfractionated grain products using micron-sized sieves.

BACKGROUND OF THE INVENTION

Pearling, de-branning, flaking, milling (grinding), sieving and air-classification are standard dry technologies for the processing of grains such as oats and barley into their component concentrates such as fiber, starch and protein. Among these dry processing technologies, the processes of milling and sieving (using sieves attached to a sieve shaker and/or vibrators) are the most commonly used and economical methods. Sieving technology typically employs sieves with openings as small as 100 μm to separate and classify milled particulates based on their particle size. When fine sieves with openings of 100 μm or less are used, clogging tends to occur and this requires slowing down the feeding rate, leading to less throughput. This causes losses in separation efficiency, and with some plant materials, it becomes impossible to continue the sieving operation. Other existing methods based on pin-milling and air-classification (PMAC) technology show efficient separation of finer particulates but suffer from low extraction rates and poor yields of targeted components. Many studies on the air-classification of grain flours from cereals, pulses, and defatted oilseed meals have been conducted. In addition, PMAC technology is extraordinarily capital intensive, with the upfront costs of equipment often exceeding $1 million to begin commercial scale production.

A review of the prior art reveals that various air classification methodologies and equipment have been used in the past that utilize a variety of different techniques to effect separation of grain components. Such methodologies include various air flow techniques and equipment designs that subject the grain to different air flows that enable component separation.

For example, U.S. Pat. No. 5,348,161 to Mueller describes an apparatus for cleaning semolina which circulates air upwards through the bottom of a sieve to separate grain fractions and selectively collects the fractions in a closed system which prevents entry and exit of dust.

U.S. Pat. No. 8,061,523 to Uebayashi, et al. describes a purifier apparatus with a vibrating sieve box and stacked sieves. The purifier operates using regulated suction updraft to spread the particles width-wise along the sieve box with respect to the direction of stacking of the sieves.

U.S. Pat. No. 4,806,235 to Mueller describes an apparatus for cleaning grain products which has vibrating superimposed screen layers. Upward vacuum suction is provided with respect to the downward direction of travel of particles though the shaking screen. Suction is regulated by flaps.

U.S. Pat. No. 4,680,107 to Manola describes a separator device with a conical tray for spreading product while it moves from an inlet under suction. The product then meets an ascending flow of air sucked from the outside by the same suction mechanism. Heavier product drops to the bottom of the container for evacuation while lighter product remains suspended and follows the flow of air exiting the device via the suction conduit.

U.S. Pat. No. 5,019,242 to Donelson describes an apparatus for cleaning particulate material. A supply auger is used to introduce material to a discharge duct for deposit onto a vibrating screen. Fine material or light-weight debris passes through the screen and is then pulled outward and upward by vacuum pull through a conduit to a collection hopper. The heavier material (whole kernel material) is deposited on a discharge auger for collection.

U.S. Pat. No. 7,424,956 to Kohno describes a separation method and device for separating lightweight grains from raw grains. In a primary separation step, the grain mixture is whirled upward with primary air along the inner wall of the cylindrical section for allowing raw grains and part of the lightweight grains to stay in a certain flow area by frictional resistance with respect to the wall surface generated by whirl, and to drop into the conical section on the downside by their own weight. Certain embodiments also use secondary and/or tertiary airflows induced by blowers.

U.S. Pat. No. 5,645,171 to Felden describes an apparatus for sorting seeds or other objects. The seeds are introduced via a delivery module into a column and lifted upwards by vacuum suction until they exit the top of the column and pass over three separate collection chambers where they are collected according to density with the lightest components proceeding towards the vacuum source.

U.S. Pat. No. 7,976,888 to Hellweg et al. describes a dry milling process for preparing oat products enriched in beta-glucan. The process involves a series of milling, bolting (fractionating) and blending steps.

U.S. Pat. No. 7,910,143 to Kvist et al. describes a process for extraction of soluble dietary fiber from oat and barley grains for producing a fraction rich in beta-glucans. The process involves milling, enzymatic treatment with starch degrading enzymes and centrifuging.

US 2011/0253601 to Kaiser et al. describes an air jet sieve device for a batch processing method proposed mainly for the determination of particle size distribution at lab scale with a sieve disposed on a sieve deck and a chamber with a rotating slotted nozzle below the sieve deck, through which air is blown upwards to purge the sieve apertures and agitate material lying on the sieve. The chamber above the sieve deck is sealed during sieving. This device is equipped with a sensor for detecting particles in the air outlet flow from the chamber underneath the sieve.

U.S. Pat. No. 4,261,817 to Edwards et al. describes a sieving apparatus (batch processing) with a suction chamber, upon which sits a sieve support structure (levitation head) defined by a central bore and two additional rings of bores. A sieve cloth sits on the top surface of the levitation head. A sieve case structure is supported by the top surface of the levitation head. The levitation head also has horizontal air passages that permit entry of air into the sieve case. This air flow serves to agitate the material being sieved and prevents blockage of the sieve. Air also flows into the sieve case through two apertures in the top cover of the sieve case.

U.S. Pat. No. 4,268,382 to Hanke et al. describes an apparatus for separating solids from a suspension. The suspension is introduced into the device through an inlet where it accumulates in a stilling chamber until it passes over an overflow edge and runs down along a sieve provided with sieving bars and gaps. The fluid drains through the gaps and the solids are transferred over the gaps and discharged through a bottom chute.

EP 0978328B2 to Kaiser et al. describes a device which is generally similar to that described in US 2011/0253601, with additional electronic control mechanisms associated with the device.

In view of the foregoing, there continues to be a need for an improved high-throughput commercial scale sieving apparatus, system and method, which is continuous and non-clogging for dry fractionation of grain to produce separate fractions enhanced in fiber, starch and/or protein with high extraction efficiency of the aforementioned targeted components at low capital and processing costs.

SUMMARY OF THE INVENTION

The present invention addresses the problem of fractionating grain products. Certain aspects of the invention produce grain product fractions with increased fiber content while other aspects of the invention produce fractions with increased content of starch and/or proteins. The system uses dynamic air currents, created under vacuum and by high pressure air pulsing, to fluidize the particulates of finely ground grain products to be filtered through a micron sized filtering sieve, leaving behind a coarser fibrous fraction above the sieve. In one example which indicates the effectiveness of the process, a high-quality beta-glucan concentrate can be obtained from barley and oat flour at approximately 50-60% of the cost of existing dry processing technologies for the production of up to 30% beta-glucan concentration fiber product. Several additional applications of the apparatus, system and method have been confirmed, including for example, separation of dietary fiber concentrates from finely ground pulse grains such as field pea, faba bean, lentil, chick pea, mung bean, among others; as well as reduction of fiber in oilseed meals (fat free) from canola, flax, hemp, soybean, sesame, among others. The equipment used in the system has no moving parts and thus requires minimal maintenance because there is little wear-and-tear. Integration of the apparatus and system into value-added grain processing operations such as wheat milling and flour production, pin-milling and air-classification of pulse grains for the production of protein concentrates (including removal of cotyledon fibers prior to separation of starch from protein by PMAC), fuel ethanol production from cereal flours (including removal of fiber from cereal flours prior to using starch/protein enriched flour in ethanol production), and wet-milling of grains for starch extraction, among others, will significantly improve the sieving rate cost efficiency and mill throughput of value-added grain processing operations.

One aspect of the present invention provides a sieving apparatus for fractionating a grain product. The sieving apparatus comprises a top chamber separated from a bottom chamber by a sieve and a top chamber cover defined by a plurality of openings. There is an inlet port in a sidewall of the top chamber which is configured for feeding of dry grain particles into the top chamber and for entry of air into the top chamber. There is a first exit port in a sidewall of the bottom chamber for exit of air and exit of a first grain fraction from the bottom chamber when the interior of the sieving apparatus is under vacuum via the exit port.

In certain embodiments, the sieving apparatus further comprises nozzles installed in the sidewall of the top chamber for pulsing high pressure air stream into the top chamber horizontally above the sieve surface.

In certain embodiments, there is a second exit port in the sidewall of the top chamber for exit of air and exit of a second grain fraction from the top chamber when the sieving apparatus is under vacuum via the second exit port.

In certain embodiments, the openings define a total void space in the top chamber cover between about 0.2% to about 0.3% of the total surface area of the top chamber cover.

In certain embodiments, the velocity of air moving through the openings is about 12 to about 18 cubic feet per minute when the vacuum strength is between about 5 to about 8 inches of Hg.

In certain embodiments, the openings are substantially evenly distributed over the surface area of the top chamber cover and individually have a diameter sufficiently small relative to an applied vacuum to induce vertical airflow within the top chamber.

In certain embodiments of the sieving apparatus, the openings in the top chamber cover are circular. The circular openings in the top chamber cover may each have a substantially identical diameter.

In certain embodiments, the top chamber itself may be cylindrical or ovoid in shape.

In certain embodiments, the distance between the underside of the cover and the surface of the sieve is about 4 to about 8 inches.

In one embodiment, the circular openings in the top chamber cover may be arranged with one central opening, five openings substantially equi-spaced in a first circle around the central opening and eleven openings substantially equi-spaced in a second circle around the first circle. In certain embodiments, each hole is about 0.5 inches in diameter.

In certain embodiments, the sieve is supported by a sieve bed dividing the top chamber from the bottom chamber. The sieve bed may be provided by a metal screen with circular openings greater than about 4 cm in diameter.

In certain embodiments, the sieve is defined by openings less than about 100 μm in diameter.

In certain embodiments, a horizontal tube with a hopper for loading a grain product is connected to the inlet port of the top chamber. The outer opening of the horizontal tube may be provided with a removable cap.

In certain embodiments, the top chamber is removable from the bottom chamber. A means for sealing the top chamber to the bottom chamber and a means for clamping the top chamber to the bottom chamber may also be provided.

In certain embodiments, the bottom chamber may be provided with a pressure gauge for measurement of the pressure state within the interior of the bottom chamber.

In certain embodiments, at least a portion of the bottom chamber is conical-shaped or frustoconical-shaped and the bottom of the bottom chamber is defined by a bottom port which is capped when the sieving apparatus is in operation and which is uncapped when cleaning and/or maintenance of the bottom chamber is desired.

In certain embodiments, the bottom port is connected to a rotatory airlock valve that allows continuous emptying of the fine particulates that pass through the sieve to the bottom chamber.

Another aspect of the present invention provides a system for fractionating a grain product. The system comprises a sieving apparatus as defined described above, a vacuum producer operably connected to the first exit port and operably connected to the second exit port, wherein the vacuum producer is configured to draw air through the openings of the top chamber cover and to draw air through the inlet port. The system also includes a first vessel for collecting fine grain particles that pass through the sieve and exit the bottom chamber via the first exit port under vacuum provided by the vacuum producer. The first vessel is operably connected to the first exit port.

In certain embodiments, the system also includes a second vessel for collecting coarse grain particles that do not pass through the sieve. The second vessel is operably connected to the top chamber via the second exit port.

In certain embodiments, the first and second vessels are cyclone separator vessels.

In certain embodiments, the first and second cyclone separator vessels are connected to the vacuum producer via a conduit system. The conduit system may include a first valve for controlling the flow of air and particles to the first cyclone separator vessel and a second valve for controlling the flow of air and particles to the second cyclone separator vessel.

In certain embodiments, the conduit system is provided with a filter to prevent fine particulates from entering the vacuum producer.

In certain embodiments, the conduit system is provided with a pressure sensor. The conduit system may also be provided with a safety valve for closing the conduit when a pre-determined excessive pressure is measured in the conduit by the pressure sensor.

In certain embodiments, the first and second cyclone separator vessels are each provided with a closable lower opening for removal of grain products collected from the sieving apparatus via the first and second exit ports, respectively. These cyclone separator vessels can also be installed with "rotatory airlock valves" (replacing the closable lower opening) in order to continuously empty the product/particulates coming into the vessel from the top and bottom chambers of the sieving device.

Another aspect of the present invention is a method for fractionating a milled grain product into coarse and fine fractions. The method comprises the steps of: a) providing a sieving apparatus with a bottom chamber divided from a top chamber by a sieve, the sieving apparatus having an inlet port in the top chamber, a first exit port in the bottom chamber, a second exit port in the top chamber and a top chamber cover defined by a plurality of openings; b) drawing grain particles through the inlet port into the top chamber by vacuum suction; c) generating turbulent air currents within the top chamber by drawing air under the vacuum suction through the openings in the top chamber cover, drawing air through the inlet port, thereby fluidizing the grain particles and preventing blockage or clogging of openings in the sieve; and d) drawing fine grain particles through the sieve and out of the bottom chamber via the first exit port under the vacuum suction, thereby enabling collection of a fine grain particle fraction.

Another embodiment of the method includes all of the steps a) to d) recited above and further comprises the step of halting the action of step d) and drawing coarse grain particles out of the upper chamber via the second exit port, thereby enabling collection of a coarse grain particle fraction which includes beta-glucans. The beta-glucans may be 1-3, and 1-4 linked cereal beta-glucans.

In certain embodiments, the halting of step d) is effected by closing a first open valve in a vacuum conduit connected to the first exit port and by opening a closed second valve in a vacuum conduit connected to the second exit port.

In certain embodiments, the coarse grain particle fraction has greater than a 300% increase, greater than a 200% increase, greater than 100% increase, greater than a 50% increase, greater than a 40% increase, greater than a 30% increase, greater than a 20% increase, or greater than a 10% increase in total dietary fiber content relative to the non-fractionated milled grain product.

In other embodiments, the coarse grain particle fraction has greater than 400% increase, greater than 300% increase, greater than a 200% increase, greater than a 100% increase, greater than a 50% increase, greater than a 20% increase, greater than a 10% increase or greater than a 5% increase in soluble dietary fiber content relative to the non-fractionated milled grain product.

In other embodiments, the fine grain particle fraction has greater than a 50% increase, greater than a 40% increase, greater than a 30% increase or greater than a 20% increase in starch content relative to the non-fractionated milled grain product.

In other embodiments, the fine grain particle fraction has greater than a 60% increase, greater than a 50% increase, greater than a 40% increase, greater than a 30% increase, greater than a 20% increase or greater than a 15% increase in protein content relative to the non-fractionated milled grain product.

In certain embodiments, the coarse fraction is substantially depleted of starch and protein.

If the milled grain product is wheat bran, the coarse fraction will be enriched in arabinoxylans and the fine fraction enriched in protein relative to the unfractionated wheat bran.

If the milled grain product is oats (which may be either native or defatted or a combination thereof), the coarse fraction will be enriched in beta-glucans relative to the unfractionated milled oats.

If the milled grain product is barley, the coarse fraction will be enriched in beta-glucans relative to the unfractionated barley.

If the milled grain product is oilseed meal, the fine fraction will be reduced in fiber relative to the unfractionated oilseed meal.

If the milled grain product is spent grain (for example from the brewing industry) or dried distillers' grains with solubles (DDGS) (for example, from the ethanol industry), the fine fraction will be enriched in protein and the coarse fraction is enriched in arabinoxylan (pentosans) relative to the unfractionated spent grain or DDGS.

If the milled grain product is flour or meal, the flour or meal is defatted before carrying out the steps of the method described herein.

In certain embodiments, the milled grain product is barley or oat grain and the enrichment of beta-glucan content is greater than 300%. In such embodiments, the total dietary fiber is also enriched by greater than 300%.

In certain embodiments the milled grain product is pulse flour or canola meal and the coarse fraction is enriched in total dietary fiber by greater than 200%.

In certain embodiments, the system is provided with a pair of valves to alternate the vacuum suction between top and bottom chambers of the device and airlock valves to facilitate continuous emptying of course and fine particulates from the collection vessels.

In certain embodiments, the system further comprises an automated valve opening and closing sequencer for operation of the pair of valves.

The system described herein may be used for production of a beta-glucan enriched coarse fraction from milled barley and oat products.

The system described herein may be used for production of fiber depleted canola meal from milled canola meal.

BRIEF DESCRIPTION OF THE DRAWINGS

Embodiments of the present invention are described with reference to the accompanying figures.

DETAILED DESCRIPTION OF THE INVENTION

Figure 1:
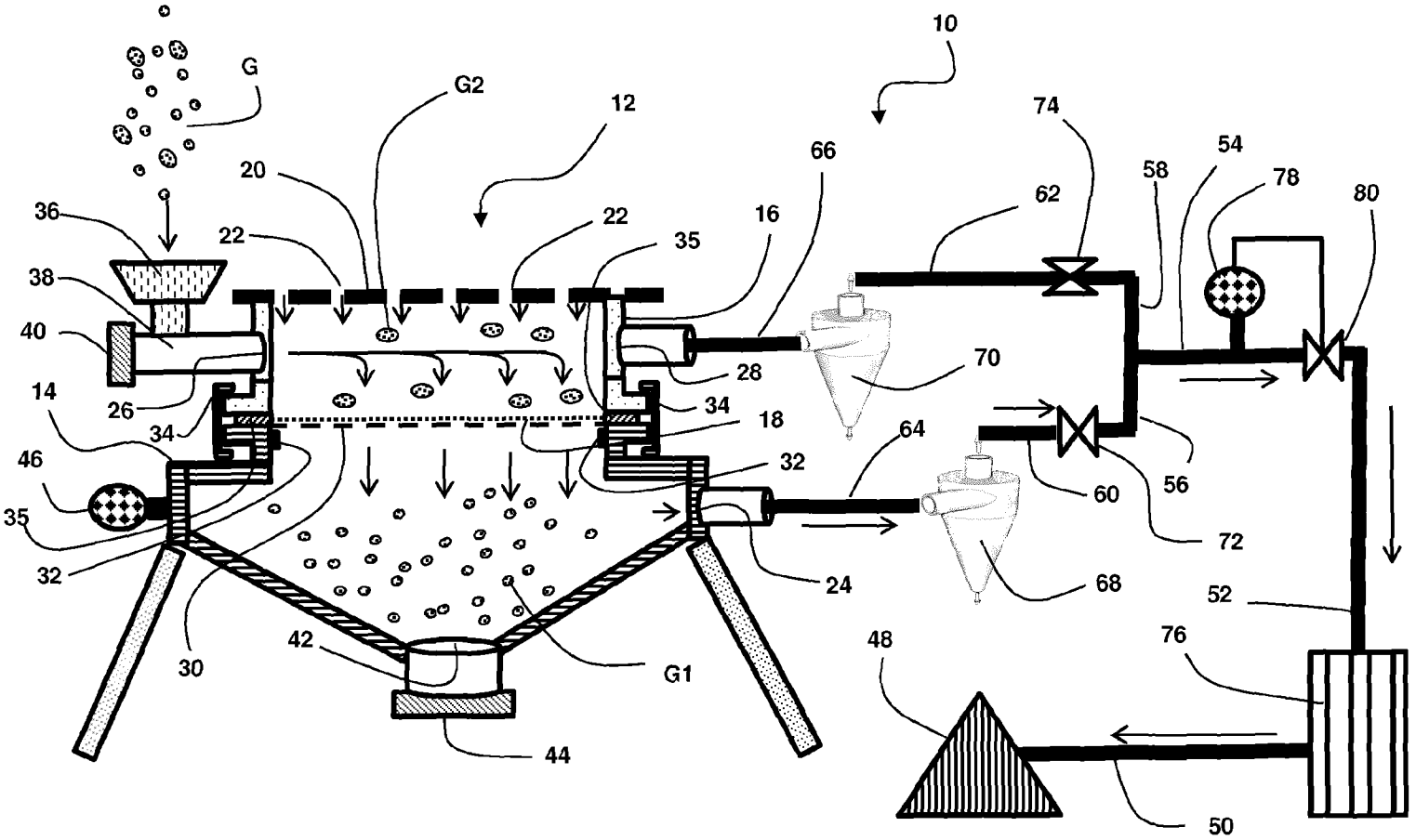
FIG. 1 shows a sieving apparatus 12 as part of a system 10 for fractionating a grain product (G) into a fine particulate fraction G1 and a coarse particulate fraction G2.

An example embodiment of a sieving apparatus and system for fractionating grain will now be described with reference to the drawings. Alternative embodiments employing alternative features will be briefly described during the course of the description of the embodiment of FIG. 1. Features of the top chamber cover are shown in FIG. 2.

One embodiment of a sieving apparatus and system is described with reference to FIG. 1. Grain fractionating system 10 includes a sieving apparatus 12 which may be formed of food-grade stainless steel or other similar materials known to those skilled in the art. The apparatus 12 includes a bottom chamber 14 separated from a top chamber 16 by a sieve 18. In certain embodiments, the bottom chamber 14 has a generally cylindrical upper portion and a frustoconical lower portion and the top chamber 16 is also generally cylindrical with a diameter substantially similar to the diameter of the upper portion of the bottom chamber 14. Advantageously for the purpose of fractionating grain products, the sieve 18 has openings with diameters less than about 100 micrometers (μm). This sieve 18 serves to fractionate a mixture of grain particles G into a fine fraction G1 (i.e. particles with smaller diameters than the diameter(s) of the sieve openings) and a coarse fraction G2 (i.e. particles with larger diameter(s) than the diameter(s) of the sieve openings).

The top chamber 16 is provided with a cover 20 which generally covers the entire diameter of the top chamber 16. The top chamber cover 20 is provided with a plurality of openings 22. One embodiment of the top chamber cover will now be briefly described with reference to FIG. 2 which shows a top view of cover 20. This particular embodiment of the top chamber cover is a circular cover 20 with a central opening 22*a*. Five additional openings 22*b* are disposed in a circle located radially outward from the central opening 22*a*. The openings 22*b* are substantially equi-spaced from each other and from the central opening 22*a*. Eleven additional openings 22*c* are disposed radially outward from openings 22*b* and substantially equi-spaced from each other. This arrangement of openings 22 is useful for generating air currents when the apparatus 12 is under vacuum suction as will be described in detail hereinbelow. Advantageously, the cover 20 may be formed of substantially transparent hard plastic, plexiglass or other hard transparent material which allows the operator to visualize the movement of grain particles within the top chamber 16 when the system 10 is operating.

Returning now to FIG. 1, the bottom chamber 14 is provided with a bottom exit port 24 through which vacuum suction is applied to the bottom chamber 14. Particles of the fine fraction G1 also pass through bottom exit port 24 for collection.

The top chamber 16 is provided with an inlet port 26 for feeding of the mixture of grain particles G via a hopper 36 and horizontal tube 38 and for allowing passage of air when the system is operating. The horizontal tube 38 is provided with a removable cap 40 to cover its outer opening, and to allow access to the interior of the tube 38 to facilitate maintenance. In certain cases, opening of the cap 40 may provide a means to increase airflow into the top chamber 16 when the system 10 is operating. The top chamber 16 is also provided with a top exit port 28 for evacuation of the coarse fraction of grain particles G2 which is collected in the top chamber 16.

In this particular embodiment, the sieve 18 rests upon a sieve bed 30 which may be constructed of a metal screen. In certain embodiments, the metal screen has openings which are greater than about 4 cm in diameter. The sieve bed 30 rests upon a ledge 32 which is formed in or attached to the inner side wall of the bottom chamber 14. The sieve 18 and sieve bed 30 may also be held in place by a seal 35 such as an o-ring, or gasket in combination with a clamp 34 for locking the top chamber 16 in place above the bottom chamber 14.

Additional optional features of the bottom chamber 14 include a bottom port 42 with a removable cap 44. This feature is provided for maintenance and cleaning of bottom chamber 14 as well as evacuation of the fine particle fraction G1 if necessary. In addition, the bottom port 42 can be attached to a "rotary airlock valve" (instead of the removable cap 44) that can continuously empty the fine particles collected in the bottom chamber. The bottom chamber 14 also optionally contains a pressure gauge 46 for measurement of air pressure within the interior of the bottom chamber 14.

Apparatus 12 as described above is shown in FIG. 1 as part of system 10 which also includes a vacuum producer 48, and a series of vacuum conduits that connect the vacuum producer 48 to the bottom exit port 24 and top exit port 28. Accordingly, in the embodiment shown in FIG. 1, vacuum producer 48 is operably connected to bottom exit port 24 of the bottom chamber 14 via conduit sections 50, 52, 54, 56, 60 and 64. Likewise, vacuum producer 48 is operably connected to top exit port 28 of the top chamber 16 via conduit sections 50, 52, 54, 58, 62 and 66.

A first cyclone separator vessel 68 is connected between conduit sections 60 and 64 for the purpose of collecting the fine grain fraction G1 via vacuum suction provided by the vacuum producer 48. Likewise, a second cyclone separator vessel 70 is connected between conduit sections 62 and 66 for the purpose of collecting the coarse grain fraction G2 which accumulates in the top chamber 16. These cyclone separator vessels 68 and 70 advantageously operate in conjunction with respective valves 72 and 74 which permit or block vacuum suction from the lower chamber 14 and top chamber 16 respectively, as will be described in more detail hereinbelow. The cyclone separator vessels 68 and 70 may be conical in shape with a dispensing opening at the apex of the cone. The apex of the cone may be provided with rotary airlock valves in a construction which is known in the art to be effective for continuous dispensing of grain products.

Figure 2:
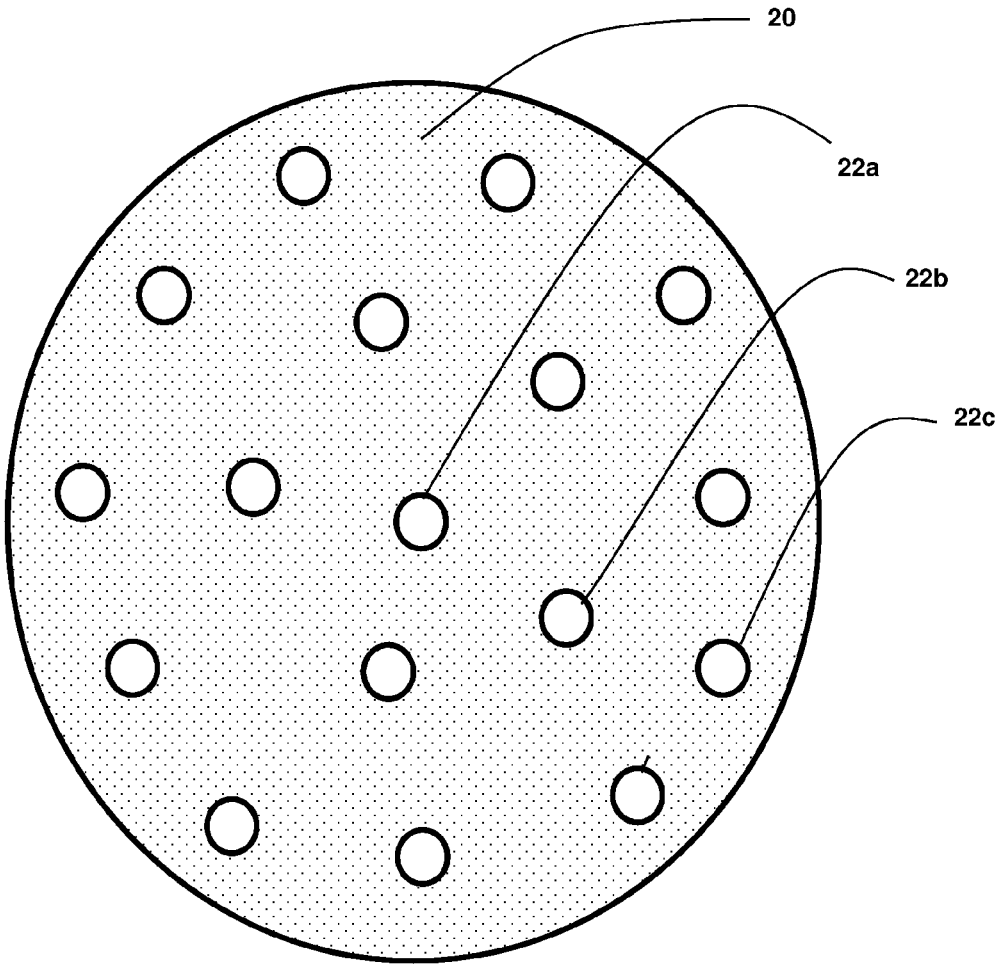
FIG. 2 shows a top view of a top chamber cover 20 which is defined by a plurality of holes 22.

The system embodiment shown in FIG. 1 has optional components including a particulate filter 76 disposed between conduit sections 50 and 52 for the purpose of preventing fine particles from entering and damaging the vacuum producer 48. Vacuum conduit pressure gauge 78 is connected to conduit section 54 for the purpose of monitoring pressure in the conduit system. This conduit pressure gauge 78 may be configured to effect closure of a safety valve 80 if the pressure exceeds a pre-determined value, which may occur if blockages occur in any of the upstream conduit sections or cyclone separator vessels.

The operation of system 10 of FIG. 1 will now be described. Valve 74 is closed and valve 72 is opened (safety valve 80 is also in its normally open position). The vacuum producer 48 is switched on and vacuum suction is applied to the vacuum conduit sections 50, 52, 54, 56, 60, and 64. As a result, air is pulled from the atmosphere into the top chamber 16 via holes 22 in the top chamber cover 20 and through the inlet port 26. Without being bound to any particular theory, it is believed that the plurality of air streams generated by holes 22 in the cover 20 moving substantially vertically downward towards and substantially perpendicular to the surface of the sieve collide with the substantially horizontal stream of air entering the top chamber 16 through the inlet port 26 and that this collision of air streams generates turbulent air currents within the top chamber 16 above the sieve 18. These turbulent air currents thoroughly stir and fluidize the unfractionated grain product G which enters the upper chamber 16 after feeding via the hopper 36 through the inlet port 26. This thorough stirring and fluidization of the grain product G prevents blockage of the openings of the sieve 18. In an alternative embodiment, high pressure air streams enter horizontally into the top chamber through nozzles (not shown) that are installed on the side wall of the top chamber and just above and parallel to the sieve surface. The pulsing of high pressure air stream done through one nozzle at a time. The air stream sweeps the sieve surface.

The entry of the unfractionated grain product G into the apparatus 12 is also facilitated by the vacuum suction provided by the vacuum producer 48. If so desired, the horizontal stream of air may be increased or regulated by installing a valve on the horizontal tube 38 between the hopper 36 and the top chamber 16 of the apparatus 12. Other means of regulating the flow of air through the inlet port 26 may be provided in alternative embodiments.

The grain product G in the top chamber 16 is then fractionated by the sieve 18. For the sake of clarity, in FIG. 1, the interior of the top chamber 16 is shown to contain only the coarse grain fraction G2 but it will be understood that initially, the unfractionated grain product G occupies the top chamber 16 until the fine particles G1 have passed through the openings of the sieve 18 and entered the bottom chamber 14, leaving the coarse grain fraction G2 in the top chamber 16. The particles of fine fraction G1 pass through the bottom exit port 24 and through vacuum conduit 64 for collection in the first cyclone separator vessel 68. When the fractionation of a dispensed amount of grain product G is judged to be complete, valve 72 is closed and valve 74 is opened. As a result, with continued operation of the vacuum producer 48, vacuum suction through conduits 60 and 64 is halted and vacuum suction through conduits 62 and 66 is initiated. This action has the effect of drawing air and coarse particles G2 from the top chamber 16 through the top exit port 28 and through conduit 66 for collection in the second cyclone separator vessel 70. In certain embodiments, both of the cyclone separator vessels 68 and 70 have rotary airlock valves installed at their bottoms, which are used to continuously empty the fine and coarse particulates collected in the vessel.

In certain embodiments, the system may operate in a cyclical manner with the following briefly described steps: (i) a pre-determined volume of unfractionated grain product G is dispensed and fractionated under vacuum suction operating via conduits 64 and 60 with valve 72 open and valve 74 closed as shown in FIG. 1 (ii) fine particles G1 are evacuated to the first cyclone separator vessel 68; and (iii) coarse particles G2 are evacuated to the second cyclone separator vessel 70. Such a cyclical process may be optimized and automated. In addition to the valve automation, the installation of the rotary airlock valves at the bottom of the bottom chamber 35, as well as the bottom of the cyclone collector vessels 68 and 70, would facilitate a continuous particle classification, collection and dispensing process. By appropriately sizing all elements of this automated continuous system, a commercial scale operation is feasible.

In certain embodiments, an automated valve opening and closing sequencer may be provided to provide a sequence of opening and closing of valves in order to achieve the required efficient grain material classification. Both valves should not remain closed as this will led to buildup of high vacuum in the conduits/tubes/vessels. The action of the sequencer may be controlled by conventional electronics, processors and programs known to the person skilled in the art.

In certain embodiments, the rate of feeding of grain material into the hopper is synchronized with the operation. For example, when suction begins through the exit port of the bottom chamber, the feeder will initiate the feeding of the grain material into the hopper and the grain material will be sucked through the inlet port into the top chamber. After feeding defined amounts of grain material into the top chamber, the feeder will stop but vacuum suction through the exit port in the bottom chamber continues to operate for defined period of time in order to perform air current assisted sieving. Once the sieving process is complete, the coarse material is collected from the top chamber. To allow this step, suction through the exit port in the top chamber is started and suction through the exit port of the bottom chamber is halted. The valve that provides suction to the top chamber is opened first, before closing the valve that provides suction to the bottom chamber.

The skilled person will recognize that the arrows indicating the direction of flow of air through the system 10 induced by the action of the vacuum producer 48 can be changed by closing the open valve 72 and opening the closed valve 74. This would cause air to flow out of the top exit port 28, and through conduit 66, through the second cyclone separator vessel 70 and through conduits 62, 58, 54, 52 and 50.

EXAMPLES

Example 1: Fractionation of Various Grain Products and Compositions

Application of the process to finely milled barley and oat flours yielded coarse fiber concentrates which were enriched in beta-glucan (up to 33% and 22%, respectively) and produced a fine particulate stream enriched in starch (up to 72% and 69%, respectively) and protein (up to 19% and 16%, respectively).

Application of the process to canola meal (13%, total dietary fiber and 37% protein) yielded a "fiber enriched"

coarse particle fraction (up to 53% total dietary fiber) and a "fiber-reduced" protein meal which was slightly enriched in protein content (up to 41% protein). Similar trends were observed with soy meal.

Application of the process to pulse flours enabled the production of a fiber enriched coarse particle fraction (up to 28% total dietary fiber content) and a fine particle fraction that is enriched in starch (up to 56%).

Application of the process to debranned, tempered and milled wheat grain yielded white wheat flour (extraction rate 69%) and a bran concentrate.

Application of the process to debranned, tempered and milled durum wheat grain yielded durum Atta wheat flour having a composition appropriate (69% starch, 14% protein and 4% dietary fiber) for the production of Indian and Arabic style flat breads

Example 2: Comparison of Grain Product Fractionation Methods

An example embodiment of the method of the present invention was employed to fractionate three different grain products (barley flour, oat flour, milled oat bran) with the aim of obtaining coarse grain fractions with increased content of beta-glucans (Table 1). The results obtained from this embodiment are compared with existing air classification technology in Table 2. The results indicate that the beta-glucan content is increased to a greater extent using the present method. The yields provided by this embodiment of the method of the present invention are superior when compared to standard air classification technology, yet require significantly less initial capital investment, and require less ongoing operational costs.

In Table 1, it can be seen that beta-glucan content (a soluble dietary fiber) is increased by up to 33% for barley flour and up to 22% for oat flour and milled oat bran. Thus, an increase in soluble dietary fiber greater than 296% in barley flour, 342% in oat flour and 243% in milled oat bran may be expected when fractionating barley and oat grain materials using embodiments of the present invention. The average total dietary fiber (TDF) of barley flour, oat flour and milled oat bran ranged between 12-13%, 11-13% and 16-19%, respectively (results not presented in Table 1). Because TDF includes soluble dietary fiber (SDF) and insoluble dietary fiber (IDF), TDF increased substantially in the coarse fraction (Table 1) when fractionating barley and oat grain material using embodiments of the present invention.

Similar fractionation testing carried out on pulse flour and canola meal resulted in increases in total dietary fiber greater than 200%. Data obtained from these tests is shown in Table 3.

The relationships between the major factors influencing the efficiency of particle separation and auto-sieve cleaning are shown in Table 4.

TABLE 1

Production of beta-glucan enriched fiber concentrates from barley and oat grain/material using the air-current assisted particle separation technology (ACAPS)

| Grain material (Type, beta-glucan content and particle size) | | | Yield and composition of fiber concentrates produced through ACAPS technology | | | | | | |
|---|---|---|---|---|---|---|---|---|---|
| Type | Beta-glucan content (%) | Flour particle size | Yield (%) | Beta-glucan (%) | Starch (%) | Protein (%) | Lipid (%) | Ash (%) | TDF (%) |
| Barley Flour | | | | | | | | | |
| Sample 1 | 6.1 ± 0.1 | 100% through 400 micron screen | 27.4 ± 0.5 | 18.1 ± 0.1 | 39.2 ± 0.6 | 18.5 ± 0.1 | 2.1 ± 0.0 | 1.6 ± 0.0 | 38.1 ± 0.1 |
| Sample 2 | 7.3 ± 0.0 | 100% through 400 micron screen | 24.8 ± 0.4 | 24.1 ± 0.2 | 37.5 ± 0.3 | 17.9 ± 0.0 | 1.9 ± 0.0 | 2.0 ± 0.0 | 40.2 ± 0.3 |
| Sample 3 | 9.2 ± 0.2 | 100% through 400 micron screen | 24.3 ± 0.2 | 33.4 ± 0.3 | 31.8 ± 0.2 | 17.2 ± 0.2 | 1.6 ± 0.1 | 1.8 ± 0.1 | 46.8 ± 0.6 |
| Oat Flour | | | | | | | | | |
| Sample 1 | 3.5 ± 0.0 | 100% through 500 micron screen | 19.1 ± 0.0 | 15.0 ± 0.0 | 42.9 ± 0.3 | 19.3 ± 0.1 | 8.5 ± 0.2 | 1.7 ± 0.0 | 26.8 ± 0.2 |
| Sample 2 | 5.2 ± 0.1 | 100% through 500 micron screen | 18.4 ± 0.2 | 19.5 ± 0.1 | 39.3 ± 0.1 | 18.9 ± 0.3 | 9.0 ± 0.2 | 1.5 ± 0.0 | 31.2 ± 0.3 |
| Sample 3 | 6.3 ± 0.1 | 100% through 500 micron screen | 17.3 ± 0.6 | 21.6 ± 0.3 | 34.5 ± 0.8 | 19.4 ± 0.2 | 10.0 ± 0.1 | 1.8 ± 0.1 | 33.9 ± 0.4 |
| Oat bran (milled) | | | | | | | | | |
| Medium Oat bran (MOB) | 5.5 ± 0.2 | 100% through 500 micron screen | 35.3 ± 0.3 | 13.4 ± 0.4 | 37.5 ± 0.2 | 20.2 ± 0.0 | 8.4 ± 0.2 | 2.0 ± 0.1 | 30.8 ± 0.1 |
| Fine oat bran (FOB) | 8.7 ± 0.1 | 100% through 500 micron screen | 28.8 ± 0.4 | 21.5 ± 0.2 | 25.2 ± 0.3 | 19.5 ± 0.1 | 8.9 ± 0.1 | 1.8 ± 0.0 | 43.8 ± 0.2 |

Values are means of three replicates ± SD;

*ACAPS = Air current assisted particle separation technology

TABLE 2

Comparison of air-current assisted particle separation technology (ACAPS) and the traditional pin-milling and air-classification (PMAC) technology for the production of beta-glucan enriched fiber concentrates from barley and oat grain/material

| Grain Material (Type, beta-glucan content and particle size) | | | Fiber Concentrates produced through ACAPS* and PMAC* | | | | | |
|---|---|---|---|---|---|---|---|---|
| | | | Process using embodiment of present Invention (ACAPS) | | | Process using traditional pin-milling and air-classification technology (PMAC) | | |
| Type | Beta-glucan content (%) | Flour particle size | Yield (%) | Beta-glucan content (%) | Beta-glucan extraction efficiency (%) | Yield (%) | Beta-glucan content (%) | Beta-glucan extraction efficiency (%) |
| Barley Flour | | | | | | | | |
| Sample 1 | 6.1 ± 0.1 | 100% through 400 micron screen | 27.4 ± 0.5 | 18.1 ± 0.1 | 81.4 ± 0.2 | 14.1 ± 0.2 | 21.2 ± 0.3 | 49.0 ± 0.2 |
| Sample 2 | 7.3 ± 0.0 | 100% through 400 micron screen | 24.8 ± 0.4 | 24.1 ± 0.2 | 84.9 ± 0.1 | 16.2 ± 0.4 | 22.4 ± 0.2 | 49.7 ± 0.3 |
| Sample 3 | 9.2 ± 0.2 | 100% through 400 micron screen | 24.3 ± 0.2 | 33.4 ± 0.3 | 88.2 ± 0.2 | 19.0 ± 0.6 | 23.1 ± 0.1 | 47.7 ± 0.2 |
| Oat Flour | | | | | | | | |
| Sample 1 | 3.5 ± 0.0 | 100% through 500 micron screen | 19.1 ± 0.0 | 15.0 ± 0.0 | 75.2 ± 0.0 | 11.2 ± 0.0 | 16.6 ± 0.2 | 53.1 ± 0.1 |
| Sample 2 | 5.2 ± 0.1 | 100% through 500 micron screen | 18.4 ± 0.2 | 19.5 ± 0.1 | 73.2 ± 0.1 | 12.6 ± 0.3 | 20.6 ± 0.4 | 49.9 ± 0.3 |
| Sample 3 | 6.3 ± 0.1 | 100% through 500 micron screen | 17.3 ± 0.6 | 21.6 ± 0.3 | 59.3 ± 0.4 | 12.0 ± 0.6 | 21.2 ± 0.2 | 40.4 ± 0.3 |
| Oat bran (milled) | | | | | | | | |
| Medium Oat bran (MOB) | 5.5 ± 0.2 | 100% through 500 micron screen | 35.3 ± 0.3 | 13.4 ± 0.4 | 86.0 ± 0.2 | 20.3 ± 0.4 | 14.2 ± 0.1 | 52.4 ± 0.2 |
| Fine oat bran (FOB) | 8.7 ± 0.1 | 100% through 500 micron screen | 28.8 ± 0.4 | 21.5 ± 0.2 | 71.2 ± 0.3 | 18.5 ± 0.7 | 22.9 ± 0.4 | 48.7 ± 0.5 |

Values are means of three replicates ± SD;
*ACAPS = Air current assisted particle separation technology; PMAC = Pin-milling and air-classification technology

TABLE 3

Yield and composition of fiber concentrates produced from pulse flour and canola meal using air-current assisted particle separation technology (ACAPS)

| Grain material type and particle size | | Yield of fiber concentrate (%) Produced | Composition of the fiber concentrates produced through ACAPS technology (composition of the native flour/material given in brackets below each value) | | | | |
|---|---|---|---|---|---|---|---|
| Type | Particle size specification | through ACAPS technology | Starch (%) | Protein (%) | Lipid (%) | Ash (%) | TDF (%) |
| Field pea flour | 100% through 400 micron screen | 18.3 ± 0.4 | 29.7 ± 0.4 (48.2 ± 0.6) | 29.6 ± 0.1 (24.8 ± 0.6) | 0.8 ± 0.0 (0.9 ± 0.0) | 2.9 ± 0.0 (3.8 ± 0.2) | 28.3 ± 0.2 (6.5 ± 0.6) |
| Lentil Flour | 100% through 400 micron screen | 20.1 ± 0.6 | 28.9 ± 0.5. (51.3 ± 0.8) | 30.7 ± 0.0 (26.1 ± 0.9) | 1.5 ± 0.1 (1.1 ± 0.2) | 3.2 ± 0.1 (3.5 ± 0.5) | 25.6 ± 0.4 (6.2 ± 0.3) |
| Canola meal (milled) | 100% through 400 micron screen | 24.2 ± 0.3 | n/a | 34.2 ± 0.2 (37.1 ± 0.9) | 1.2 ± 0.1 (3.3 ± 0.5) | 8.7 ± 0.1 (5.9 ± 0.4) | 52.9 ± 1.5 (13.3 ± 0.7) |

Values are means of three replicates ± SD
*ACAPS = Air current assisted particle separation technology

TABLE 4

Relationships among the major factors influencing the efficiencies of particle separation (PSE) and "auto sieve cleaning"(ASCE)

| | Vacuum strength ("Hg) | Diameter of the hole on the top cover (inches) | Number of holes (i.e. % void in the top cover) | Velocity of the air through the holes (m/s) | Distance between top cover and sieve bed (inches) | Volume of air (CFM) |
|---|---|---|---|---|---|---|
| Vacuum strength (inches Hg) | | | | X | X | X |

TABLE 4-continued

Relationships among the major factors influencing the efficiencies of particle separation (PSE) and "auto sieve cleaning"(ASCE)

| | Vacuum strength ("Hg) | Diameter of the hole on the top cover (inches) | Number of holes (i.e. % void in the top cover) | Velocity of the air through the holes (m/s) | Distance between top cover and sieve bed (inches) | Volume of air (CFM) |
|---|---|---|---|---|---|---|
| Diameter of the holes on the top cover (inches) | | | | X | | X |
| Number of holes (i.e. % void in the top cover) | X | | | | | X |
| Velocity of air through the holes (m/s) | X | X | | | | X |
| Volume of air (cubic feet per minute, CFM) | X | X | X | X | | |

Concluding Statements

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A method for fractionating a milled grain product into coarse and fine fractions, the method comprising:

a) providing a sieving apparatus with a bottom chamber divided from a top chamber by a sieve, the sieving apparatus having an open inlet port in the top chamber, a top chamber cover defined by a plurality of openings, and a first exit port in the bottom chamber;

b) applying vacuum suction to the sieving apparatus through the first exit port, the vacuum suction providing the effects of:

i) drawing grain particles through the open inlet port into the top chamber, ii) generating substantially horizontal airflow in the top chamber via the inlet port; and generating substantially vertical airflow in the top chamber via the plurality of openings, wherein the substantially horizontal airflow and the substantially vertical airflow combine to generate turbulence which fluidizes the grain particles in the upper chamber and prevents blockage of the sieve; and iii) drawing fine grain particles through the sieve and out of the bottom chamber via the first exit port under the vacuum suction; and c) collecting a fine grain particle fraction.

2. The method of claim 1, wherein the sieving apparatus further comprises a plurality of nozzles installed in the sidewall of the top chamber for pulsing high pressure air stream into the top chamber horizontally above the sieve surface.

3. The method of claim 1 wherein the sieving apparatus further includes a second exit port in the top chamber and the method further comprises the step of periodically drawing coarse grain particles out of the upper chamber via the second exit port under the vacuum suction without halting the collecting of the fine particle fraction via the first exit port under the vacuum suction, thereby collecting a coarse grain particle fraction.

4. The method of claim 3, further comprising a step of first opening a closed second valve in a second vacuum conduit connected to the second exit port effecting the collection of the coarse grain particles and then halting the collection of the fine grain particle fraction by closing a first open valve in a first vacuum conduit connected to the first exit port.

5. The method of claim 1, wherein the milled grain product is barley or oat grain and the method enriches beta-glucans in the coarse grain fraction.

6. The method of claim 5, wherein the beta-glucans are 1-3, and 1-4 linked cereal beta-glucans.

7. The method of claim 1, wherein the coarse fraction is substantially depleted of starch.

8. The method of claim 1, wherein the milled grain product is wheat bran and the coarse fraction is enriched in arabinoxylans relative to the unfractionated wheat bran.

9. The method of claim 1, wherein the milled grain product is oats and the coarse fraction is enriched in beta-glucans relative to the unfractionated oats.

10. The method of claim 1, wherein the milled grain product is barley and the coarse fraction is enriched in beta-glucans relative to the unfractionated barley.

11. The method of claim 1, wherein the milled grain product is oilseed meal and the fine fraction is reduced in fiber relative to the unfractionated oilseed meal.

12. The method of claim 1, wherein the milled grain product is dried distillers' grains with solubles (DDGS) and the fine fraction is enriched in protein relative to the unfractionated DDGS.

13. The method of claim 1, wherein the milled grain product is pulse flour or canola meal and the coarse fraction is enriched in total dietary fiber relative to unfractionated pulse flour or canola meal.

14. The method of claim 1, wherein the milled grain product is pulse flour and the fine fraction is enriched in starch relative to the unfractionated flour.

15. The method of claim 1, wherein the milled grain product is flour or meal which is defatted before performing steps a) to c).

16. The method of claim 1, wherein the top chamber is removable from the bottom chamber.

17. The method of claim 1, wherein a horizontal tube with a hopper for loading a grain product is connected to the inlet port.

18. The method of claim 1, wherein the top chamber is removable from the bottom chamber.

19. The method of claim 1, wherein at least a portion of the bottom chamber is conical-shaped or frustoconical-shaped and the bottom of the bottom chamber is defined by a bottom port which is capped when the sieving apparatus is in operation and which is uncapped during cleaning and/or maintenance of the bottom chamber.

20. The method of claim 19, wherein the bottom port is provided with a rotary airlock valve for continuous emptying of fine particulates from the bottom chamber while under vacuum.

* * * * *